United States Patent [19]

Gary

[11] Patent Number: 4,901,960

[45] Date of Patent: Feb. 20, 1990

[54] DECORATIVE LIGHT HOLDER

[75] Inventor: Lonnie F. Gary, Lubbock, Tex.

[73] Assignee: Gary Products Group, Inc., Lubbock, Tex.

[21] Appl. No.: 257,392

[22] Filed: Oct. 13, 1988

[51] Int. Cl.[4] ..... A47B 96/00

[52] U.S. Cl. ..... 248/205.3; 248/316.1; 362/249

[58] Field of Search ..... 248/205.3, 205.4, 314, 248/231.8, 316.7, 317, 903; 362/249, 457

[56] References Cited

U.S. PATENT DOCUMENTS

| | | | |
|---|---|---|---|
| 1,895,656 | 1/1933 | Gadke | 248/231.8 X |
| 2,889,451 | 6/1959 | Longo | 248/314 X |
| 3,189,310 | 6/1965 | Trueson | 248/314 |
| 3,436,102 | 4/1969 | Shelly | 248/903 X |
| 3,504,169 | 3/1970 | Freeburger | 362/249 |
| 3,692,993 | 9/1972 | Robinson | 362/249 X |
| 3,713,614 | 1/1973 | Taylor | 248/205.3 X |
| 3,856,249 | 12/1974 | Frye | 248/205.3 |
| 4,667,276 | 5/1987 | Cheng | 362/249 |
| 4,756,498 | 7/1988 | Frye | 248/205.3 |
| 4,779,177 | 10/1988 | Ahroni | 362/249 X |

*Primary Examiner*—Ramon O. Ramirez

*Attorney, Agent, or Firm*—Ross, Howison, Clapp & Korn

[57] ABSTRACT

A decorative light holder comprising a base member, socket support members projecting substantially perpendicularly away from the base member, and an adhesive member adapted to secure the base member to a substantially planar support surface. The socket support member further comprises a pluralty of spaced apart socket support arms comprising facing surfaces adapted to provide frictional engagement with the outside surface of a decorative light socket.

2 Claims, 2 Drawing Sheets

DECORATIVE LIGHT HOLDER

TECHNICAL FIELD

This invention relates to decorative lighting, and more particularly, to apparatus for supporting and maintaining decorative lights on a substantially planar surface. One aspect of the invention relates to a decorative light holder having a self-adhesive backing. Another aspect of the invention relates to a decorative light holder structurally adapted to maintain its dimensional stability during prolonged use.

BACKGROUND OF THE INVENTION

The use of ornamental lighting for holiday decorating is well known. Strings of decorative lights comprising, for example, twenty-five, fifty, or one hundred individual sockets are typically wired together in either series or parallel circuits with strands of insulated, small-diameter wire to which a plug or plugs are attached at one or both ends to facilitate connection with an electrical energy source or another strand of lights. Clear or colored bulbs are inserted into the sockets to provide the desired lighting effect.

The sockets utilized with such light strings sometimes employ a metal or plastic clip for use in attaching the individual sockets to an elongated support member such as a Christmas tree limb, or the like. Problems have been encountered, however, where the desired decorative lighting scheme requires the attachment of decorative light strings to a substantially planar support surface. Those of ordinary skill in the art have previously sought to overcome this problem by providing decorative light holders adapted to be maintained on a substantially planar underlying support surface by screw-type fasteners, nails, or the like. One such light holder is disclosed in U.S. Pat. No. 3,189,310. The holder disclosed in U.S. Pat. No. 3,189,310 comprises a base portion and a substantially cylindrical wall having two oppositely disposed horizontal slots. A hole through the base is adapted to receive a screw for securing the holder to a window molding or the facia or eaves of a house. The slots are designed to accommodate the wires extending in either direction from the base of a light socket, and the inside surface of the cylindrical wall is said to taper inwardly at its open end to grip a decorative light socket.

Several disadvantages are experienced through use of a decorative light holder as disclosed in U.S. Pat. No. 3,189,310. First, the necessity for using a screw fastener to attach the decorative holder to an underlying support surface is both difficult and time consuming, and leaves a hole in the support surface once the screw is removed. Second, screws arre undesirable for use in attaching decorative lights to support surfaces made of glass. Third, the cylindrical wall sections disclosed in U.S. Pat. No. 3,189,310 require a substantially thick wall in order to provide the required support and maintain their dimensional stability during prolonged use. Fourth, a decorative light holder having an inside wall tapered as required by U.S. Pat. No. 3,189,310 permits excessive wobble when utilized with conventional, commercially available light sockets as depicted in FIG. 4 herein.

A decorative light holder is therefore needed that is adapted to support and maintain an individual socket of a decorative light string on a substantially planar support surface without permanently damaging or defacing the support surface. Furthermore, a decorative light holder is needed that can be quickly and conveniently applied to a glass or plastic support surface and thereafter removed for subsequent reuse. A decorative light holder is also needed that can provide adequate lateral support for a decorative bulb socket after prolonged use, without the need for substantially thick sidewalls. Such a decorative light holder is provided herein.

SUMMARY OF THE INVENTION

According to the present invention, decorative light holders are provided that can be quickly and easily attached to substantially planar underlying support surfaces without the need for screws, nails, staples, or other fasteners that must be inserted into or embedded within the underlying support surface. The subject fasteners can be attached to surfaces such as wood, masonry, glass or plastic, and thereafter removed as desired without permanently injuring or defacing the underlying surface.

According to a preferred embodiment of the invention, a decorative light holder is provided that comprises a base member, means projecting substantially perpendicularly from said base member to frictionally engage the socket of a decorative light, and an adhesive pad adapted to secure the rearwardly facing surface of the base member to a substantially planar underlying support surface.

According to another embodiment of the invention, a decorative light holder is provided in which at least a portion of the means projecting substantially perpendicularly from the base member further defines a plurality of wall sections having voids therebetween that are adapted to frictionally engage the outside wall of a decorative light socket.

According to another embodiment of the invention, a decorative light holder is provided that comprises at least one brace member substantially perpendicular to the base member of the decorative light holder and also substantially perpendicular to the outside surface of the divided socket support member, which projects perpendicularly from the base member.

According to another embodiment of the invention, a decorative light holder is provided in which the inwardly facing surfaces of the socket support member are substantially flat.

According to another embodiment of the invention, a decorative light holder is provided in which the inwardly facing surfaces of the socket support member are arcuate.

According to another preferred embodiment of the invention, a decorative light holder is provided in which one major surface of the adhesive member is adhesively secured to the rearwardly facing surface of the base member, and in which the other major surface of the adhesive member is covered by a relatively thinner sheet material adapted to be peeled off prior to installing the decorative light holder on a substantially planar support surface.

BRIEF DESCRIPTION OF DRAWINGS

The apparatus of the invention is further described and explained in relation to the following drawings in which.

Like numerals are used to indicate like parts in all figures of the drawings.

DESCRIPTION OF THE PREFERRED EMBODIMENTS

Figure 1:
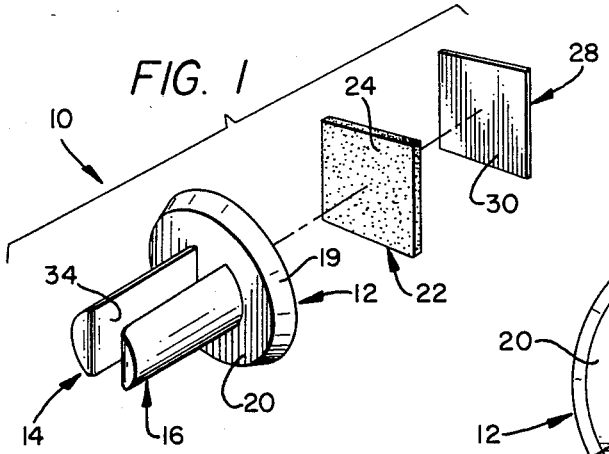
FIG. 1 is an exploded perspective view depicting the decorative light holder of the invention in combination with a sheet material adapted to cover the rearwardly facing surface of the adhesive member until the time of use.
Figure 2:
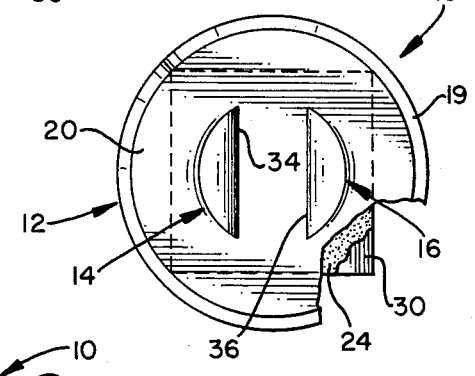
FIG. 2 is a front elevation view of the combination of FIG. 1 in which the base member of the decorative light holder is partially broken away to reveal the adhesive member, and the adhesive member is partially broken away to reveal the covering sheet material as shown in FIG. 1.
Figure 3:
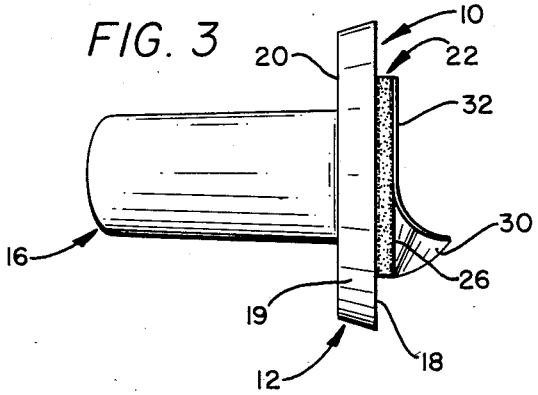
FIG. 3 is a side elevation view depicting the combination of FIG. 1 in assembled rather than exploded form, with one corner of the covering sheet material peeled back from the rearwardly facing major surface of the adhesive member.

Referring to FIGS. 1 through 4, decorative light holder 10 preferably comprises base member 12, opposed socket support members 14, 16, adhesive member 22 and overlying sheet material 28. Base member 12 and divided socket support members 14, 16 are desirably injection molded from any suitable moldable polymeric material. A preferred material for use in making the decorative light holders of the invention comprises a major portion of a moldable acrylic resin.

Decorative light holder 10 is preferably made by injection molding, and adhesive member 22 is thereafter applied to rearwardly facing surface 18 of base member 12. Adhesive member 22 is preferably a pad of polymeric foam material either coated or saturated with a conventional contact adhesive capable of releasably adhering to plastic, glass, wood or masonry surfaces. Such "stick-on" pads are commercially available, and pads approximately 0.16 centimeter thick and made of porous foamed or woven material should function satisfactorily within the scope of the invention. Adhesive member 22 can be applied to rearwardly facing surface 18 of base member 12 at the site of manufacture or at the site of use. If adhesive member 22 is applied to base member 12 at the site of manufacture, overlying sheet material 28 having a forward facing surface 30 substantially co-extensive with rearward facing surface 26 of adhesive member 22 desirably remains attached to adhesive member 22 until the time of use. Overlying sheet material 28 preferably comprises a coated paper or a polymeric material adapted to releasably adhere to the surface of adhesive member 20.

According to another embodiment of the invention, a plurality of decorative light holders 10 are made available in packages comprising a plurality of molded plastic devices further commprising a base member 12 and opposed socket support member 14, 16, in combination with a plurality of adhesive members 22 having overlying sheet material 28 disposed on both forwardly facing surfaces 24 and rearwardly facing surface 26 of adhesive member 22. At the use sight, overlying sheet material 28 is first peeled from forwardly facing surface 24 which is then pressed into contact with rearwardly facing surface 18 of base member 12.

Figure 4:
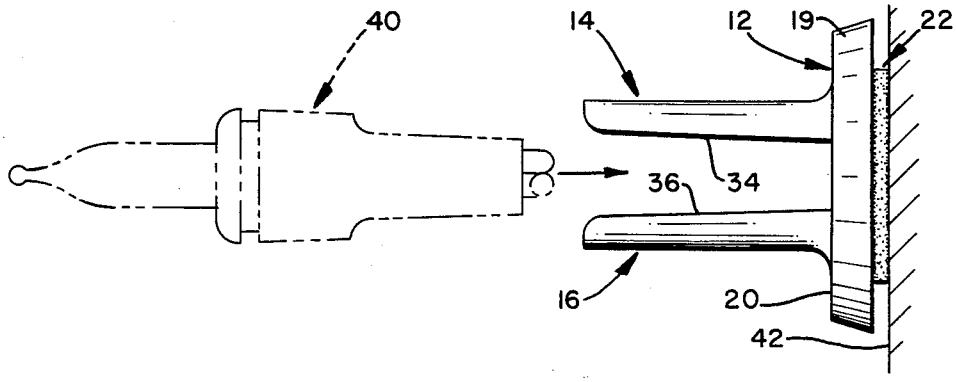
FIG. 4 is a plan view depicting the decorative light holder of FIGS. 1, 2 and 3 with the covering sheet material removed and installed on a substantially planar underlying surface, with one bulb/socket/conductor unit of a decorative light string shown in phantom in the position in which the socket would be inserted into the decorative light holder.

To apply decorative light holder 10 to a support surface 42 as shown in FIG. 4, overlying sheet material 28 is peeled away from rearwardly facing surface 26 of adhesive member 22, and base member 12 is then pressed against substantially planar support surface 42 so that adhesive member 22 establishes a bond therebetween. Adhesive member 22 is desirably selected so that the bond established between base member 12 and planar support member 42 can be broken whenever base member 12 is grasped and pulled away from support surface 42 by manual force.

As shown in FIGS. 1 through 4, socket support members 14, 16 comprise substantially planar surfaces 34, 36, respectively, which are spaced apart on forwardly facing surface 20 of base member 12 so as to provide frictional engagement with the socket portion of bulb/socket/conductor unit 40 when inserted therebetween. As shown in FIG. 4, surfaces 34, 36 of socket support members 14, 16 are substantially perpendicular to forwardly facing surface 20 of base member 12, but taper slightly in toward each other near base member 12 (opposite to the direction of taper disclosed in U.S. Pat. No. 3,189,310).

According to a particularly preferred embodiment of the invention, socket support memberes 14, 16 are sized so as to frictionally engage sockets adapted for use with conventionally sized 3.5 volt CH659 bulbs.

Although base member 12 is shown as being round and adhesive member 22 is shown as being square in FIGS. 1 through 4, it will be apparent that other geometries can also be used effectively within the scope of the invention provided that base member 12 has a substantially planar rearwardly facing surface 18 and that adhesive member 22 has substantially planar forwardly and rearwardly facing surfaces 24, 26 that do not extend outwardly beyond edge 19 of base member 12.

Figure 5:
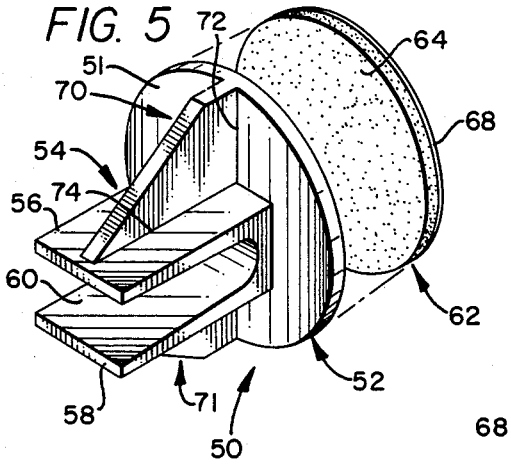
FIG. 5 is an exploded perspective view of another embodiment of the subject decorative light holder in which the adhesive member is shown as being spaced apart from the rearwardly extending surface of the base member.
Figure 6:
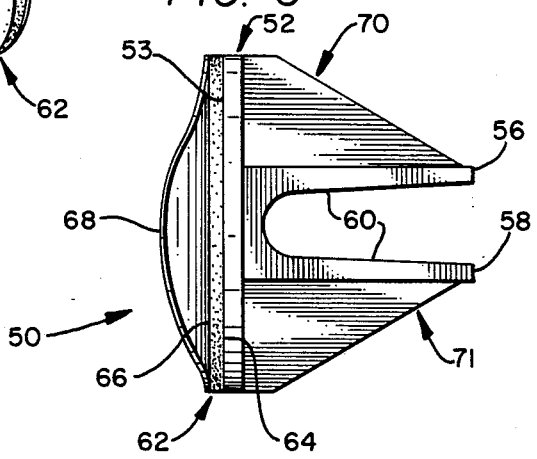
FIG. 6 is a side elevation view of the decorative light holder shown in FIG. 5 wherein the adhesive member is no longer depicted as being exploded away from the rearwardly facing surface of the base member, but in which the sheet material overlying the rearwardly facing major surface of the adhesive member has been partially peeled back away from the adhesive member.

Referring to FIGS. 5 and 6, another preferred embodiment of the invention, decorative light holder 50 is shown which comprises base member 52, socket support member 54, comprising socket support arms 56, 58, brace members 70, 71 and adhesive member 62. In this embodiment of the invention, adhesive member 62 is substantially co-extensive with rearwardly facing surface 53 of base member 52. Overlying sheet material 68 is shown in FIG. 5 in co-extensive and contacting relation with rearwardly facing surface 66 of adhesive member 62. In FIG. 6, overlying sheet material 68 is shown as being partially peeled away from rearwardly facing surface 66 of adhesive member 62.

In FIG. 5, adhesive member 62 is depicted in exploded fashion so as to better illustrate the appearance of forwardly facing surface 64 although it is understood that in application, forwardly facing surface 64 of adhesive member 62 is in substantially co-extensive and contacting relation with rearwardly facing surface 53 of base member 52 as shown in FIG. 56.

Brace members 70, 71 are preferably unitarily molded with socket support member 54 and base member 52 so as to provide structural support to socket support arms 56, 58. Inwardly facing surface 60 of socket support member 54 is a generally U-shaped surface that tapers inwardly near forwardly facing surface 51 of base member 52 in order to provide better frictional engagement with the similarly tapered surfaces of a conventional "mini-light" socket as depicted in bulb/socket/conductor unit 40 in FIG. 4. A major portion of brace member 70 preferably lies in a plane substantially perpendicular to the plane of forwardly facing surface 51 of base member 52, and also substantially perpendicular to the outwardly facing surface of socket support arm 56, which is in turn substantially perpendicular to surface 51. Intersection line 72 between brace member 70 and forwardly facing surface 51 of base member 52 is preferably substantially perpendicular to socket support arm 56; line of intersection 74 between brace member 70 and socket support arm 56 is desirably perpendicular to surface 51 and lines of intersection 72, 74 are desirably perpendicular to each other. As shown in FIGS. 5 and 6, inwardly facing surface 60 of socket support arms 56, 58 of socket support member 54 is substantially flat, except for the curved portion near base member 52.

Figure 7:
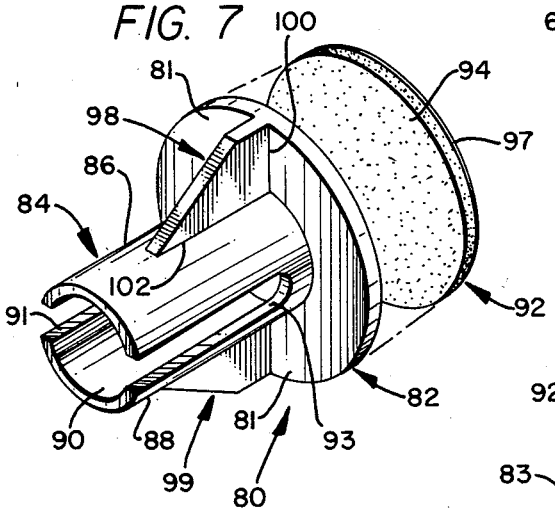
FIG. 7 is an exploded perspective view of another embodiment of the invention in which the adhesive member and its overlying sheet material are shown as being exploded away from the rearwardly facing surface of the base member.
Figure 8:
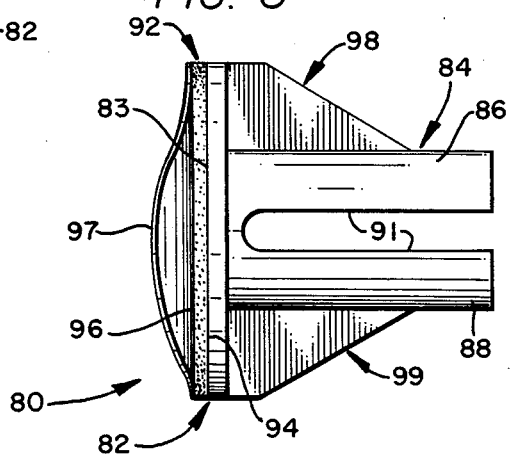
FIG. 8 is a side elevation view depicting the apparatus of FIG. 7 wherein the adhesive member is no longer expoded away from the rearwardly facing surface of the base member, but in which a portion of the overlying sheet material has been peeled back from the rearwardly facing surface of the adhesive member.

Referring to FIGS. 7 and 8, a particularly preferred embodiment of the subject apparatus is shown wherein decorative light holder 80 preferably comprises base member 82, socket support member 84, adhesive member 92 and brace members 98, 99. Base member 82 preferably comprises forwardly facing surface 81 and rearwardly facing surface 83. Socket support member 84 preferably comprises a plurality of spaced apart socket support arms 86, 88 having arcuate inwardly facing surfaces substantially perpendicular to forwardly facing surface 81 of base member 82 as illustrated by surface 90 of socket support arm 88. Edges 91, 93 of socket support arms 86, 88 preferably define a substantially rectangular slot adapted to accommodate the wires of a conventional "mini-light" electrical socket inserted into frictional engagement with the inwardly facing surfaces of socket support member 84. Adhesive member 92 is depicted in FIG. 7 as being exploded away from base member 82, but in actual use is understood to be in contacting relation with rearwardly facing surface 83 of base member 82 as shown in FIG. 8. Overlying material 97 shown in co-extensive and substantially contacting relation with rearwardly facing surface 96 of adhesive member 92 in FIG. 7 but is shown being peeled away from surface 96 in FIG. 8.

Brace member 98 is shown as being substantially perpendicular to both the plane of forwardly facing surface 81 of base member 82 and the outwardly facing surface of socket support arm 86 of socket support member 84, as demonstrated by lines of intersection 100, 102, respectively, which are also preferably substantially perpendicular to each other.

Brace members 70, 71 and 98, 99 as shown in FIGS. 5–8 are particularly useful for maintaining the dimensional stability of socket support members 54, 84 even after decorative light holders 50, 80 are subjected to heating, or stretching through prolonged or repeated use. Adhesive members 62, 82 are desirably adapted to be removed from base members 52, 82 following use so that new adhesive members can be applied to such base members at a later date for further use. Once removed from base member 52, 82, adhesive members 62, 92, respectively, can be disposed of.

It is also seen from the figures of the drawings that the geometry of the socket support members and socket support arms can vary within the scope of the invention so long as adequate frictional contact is established between the inwardly facing surface or surfaces of the socket support member and the outwardly facing surface of a conventional decorative light socket, while also providing space for the wires connected to the socket whenever the socket is inserted into the decorative light holder.

Other alterations and modifications of the subject invention will become apparent to those of ordinary skill in the art upon reading this disclosure, and it is intended that the scope of Applicant's invention be limited only by the broadest interpretation of the appended claims to which the Inventor may be legally entitled.

What is claimed is:

1. An injection molded thermoplastic holder adapted to frictionally engage and support the outwardly facing surface of a decorative light socket, said holder comprising a base member and socket support means;

said base member comprising a substantially planar mounting surface;

said socket support means comprising opposed and spaced apart socket support arms projecting outwardly from said base member, said socket support arms having facing surfaces that taper in slightly toward each other near said base member so as to frictionally engage said decorative light socket;

said holder further comprising unitarily molded brace means, said brace means comprising at least two brace members providing structural support between said base member and said support arms, each brace member being substantially perpendicular to said base member and to the facing surface of one of said support arms.

2. The holder of claim 1 in combination with an adhesive member adapted to secure the substantially planar mounting surface of said base member to a substantially planar support surface.

* * * * *